US010453588B2

(12) United States Patent
Blair et al.

(10) Patent No.: US 10,453,588 B2
(45) Date of Patent: Oct. 22, 2019

(54) FIRE RESISTANT CABLE

(71) Applicant: PRYSMIAN S.P.A., Milan (IT)

(72) Inventors: Ronald Blair, North Dighton, MA (US); Walter Constantine, North Dighton, MA (US); Kendall Waterman, North Dighton, MA (US)

(73) Assignee: PRYSMIAN S.p.A., Milan (IT)

( * ) Notice: Subject to any disclaimer, the term of this patent is extended or adjusted under 35 U.S.C. 154(b) by 90 days.

(21) Appl. No.: 15/549,911

(22) PCT Filed: Feb. 10, 2015

(86) PCT No.: PCT/IB2015/000605

§ 371 (c)(1),
(2) Date: Aug. 9, 2017

(87) PCT Pub. No.: WO2016/128785

PCT Pub. Date: Aug. 18, 2016

(65) Prior Publication Data

US 2018/0033522 A1 Feb. 1, 2018

(51) Int. Cl.

| | |
|---|---|
| ***H01B 7/295*** | (2006.01) |
| ***H01B 3/04*** | (2006.01) |
| ***H01B 3/28*** | (2006.01) |
| ***H01B 7/02*** | (2006.01) |
| ***H01B 13/08*** | (2006.01) |

(52) U.S. Cl.
CPC ..... *H01B 7/295* (2013.01); *H01B 3/04* (2013.01); *H01B 3/28* (2013.01); *H01B 7/0225* (2013.01); *H01B 13/08* (2013.01)

(58) Field of Classification Search
CPC ..... H01B 7/295
See application file for complete search history.

(56) References Cited

U.S. PATENT DOCUMENTS

| | | | |
|---|---|---|---|
| 6,495,760 B1 | 12/2002 | Castellani et al. | |
| 6,552,112 B1 | 4/2003 | Redondo et al. | |
| 6,924,031 B2 | 8/2005 | Grizante Redondo et al. | |
| 8,097,809 B2 | 1/2012 | Galletti et al. | |
| 2004/0152910 A1* | 8/2004 | Fukuoka | C07F 9/65815 558/75 |
| 2013/0062097 A1 | 3/2013 | Hammond et al. | |
| 2014/0008098 A1 | 1/2014 | Scaglione et al. | |

FOREIGN PATENT DOCUMENTS

| | | | |
|---|---|---|---|
| EP | 0 893 801 | | 1/1999 |
| EP | 0 893 802 | | 1/1999 |
| EP | 1 619 694 | | 1/2006 |
| EP | 1 798 737 | A1 | 6/2007 |
| EP | 2 682 951 | A1 | 1/2014 |
| FR | 2 573 910 | | 5/1986 |
| GB | 1 169 693 | A | 11/1969 |
| GB | 1169693 | * | 11/1969 |
| GB | 2 448 778 | | 10/2008 |
| GB | 2 480 452 | A | 11/2011 |
| WO | WO 9602920 | A1 | 2/1996 |
| WO | 2006005426 | * | 1/2006 |
| WO | WO 2006/005426 | A1 | 1/2006 |

OTHER PUBLICATIONS

International Search Report from the European Patent Office in corresponding International Application No. PCT/IB2015/000605 dated Oct. 21, 2015.
Written Opinion of the International Searching Authority from the European Patent Office in corresponding International Application No. PCT/IB2015/000605, dated Oct. 21, 2015.

* cited by examiner

*Primary Examiner* — Kuo Liang Peng

(74) *Attorney, Agent, or Firm* — Finnegan, Henderson, Farabow, Garrett & Dunner, L.L.P.

(57) ABSTRACT

An electrical cable includes a conductor and a couple of mica tapes surrounding the conductor. The couple of mica tapes are formed of a first mica tape and a second mica tape wound around the first mica tape. Each of the first and the second mica tape includes a mica layer attached to a backing layer. The mica layer of the first mica tape faces and contacts the mica layer of the second mica tape.

16 Claims, 1 Drawing Sheet

FIRE RESISTANT CABLE

TECHNICAL FIELD

The present disclosure relates generally to a cable, and more particularly, to a fire resistant cable.

BACKGROUND

Many cables, in particular cables for the transmission and/or distribution of power, may be susceptible to failure in a fire-related emergency. Many cables are not designed to sustain operation at high and/or rapidly increasing temperatures, as experienced in a fire.

The fire resistance of an electrical cable may be evaluated and certified by national and international standards. These standards generally involve testing the electrical cable to prove its capacity for operating in the presence not only of fire for a given time span, but also of water possibly coming from sprinklers or hoses.

Fire resistant (or resistive) cables may be evaluated for compliance with standards developed by the US certification company known as Underwriters Laboratories (UL), such as UL Standard 2196, 2012 ("UL-2196"). To obtain certification, cables are tested under fire conditions. During the test, the cables are installed in conduits, e.g., the tubing system used for protection and/or routing of the cable, and the conduits are mounted on a fire wall, e.g., a wall that restricts the spread of fire, either vertically or horizontally in accordance with the particular test. The conduits may contain multiple cables, and the cables may fill the respective conduit to no greater than 40% as according to NFPA (National Fire Protection Association) 70: National Electrical Code (NEC). The cables are tested at the maximum-rated voltage of the cable or the utilization voltage of the cable, and remain energized throughout the test. Temperature rise and fire conditions are prescribed. After the test, the cables are de-energized, and the wall is hosed down to determine the structural integrity of the installed system. After the hose stream, the cables are re-energized in 30 minutes or less to assess the electrical integrity of the cables.

The conduits that pass the test are certified in a given configuration. For example, if a conduit with a 14% conduit fill passes the test, but does not pass the test with a 32% conduit fill, then only the conduit with the 14% conduit fill is certified. However, a conduit passing the test with a higher fill also certifies a conduit having a lower fill.

Certification under UL-2196 may involve a one-hour test or a two-hour test. In 2012, research conducted by UL showed that some products and systems similar to those previously certified under UL-2196 could no longer consistently pass the two-hour fire wall test. UL initiated an interim program with more stringent revised guidelines for certification. Cables that have achieved certification under the interim program typically include metallic coverings or armor, but the provision of armor makes the cable heavier, more expensive, and less flexible.

One method of improving the high temperature performance of a cable includes providing the cable with an extruded covering formed of one or more heat resistant materials. The extruded coverings may incorporate fillers to increase heat resistance.

Another method of improving the high temperature performance of a cable includes providing the cable with mica tape made with glass fibers on one side of the mica tape and mica on the opposite side of the mica tape. The mica tape is wrapped around a conductor during production, and one or more outer layers are applied over the layer of mica tape. Upon being exposed to increasing temperatures, the outer layers may degrade and fall away, but the glass fibers may hold the mica in place.

Mica tape manufacturers typically instruct users to apply the mica tape with the mica side facing the conductor. For example, the brochure from Cogebi Inc. for Firox® P discloses a tape made of phlogopite mica paper bonded to an electrical grade glass cloth as the supporting fabric and impregnated with a high temperature resistant silicone elastomer. The brochure discloses that the tape is applied over a conductor with the mica side facing the conductor to act as electrical insulation in the event of fire.

Also, the brochure from Von Roll Switzerland Ltd for Cablosam® 366.21-30 discloses a flexible muscovite Samica® tape impregnated with a silicone resin and reinforced with woven glass. The woven glass forms a backing surface. The brochure discloses that the tapes are applied onto the bare wire strand always with the woven glass to the outside after application. Thus, the brochure describes that the tape is applied to the conductor with the mica side facing the conductor.

European Publication EP 1 798 737 (EP '737) discloses an electric cable including a plurality of electrically conductive wires, on each of which is applied a layer comprising a glass fiber strip with a mica layer glued thereon. EP '737 applies a single mica layer and does not disclose which side of the layer with the glass fiber strip and the mica layer faces the conductive wires.

PCT International Publication WO 96/02920 (WO '920) discloses a cable including two layers of glass-cloth-backed mica tape applied over a wire conductor. WO '920 discloses that the mica tapes layers are applied with the glass cloth on the outside of the layer, and therefore that the mica side faces the conductor.

European Publication EP 1 619 694 (EP '694) discloses a cable including a conductor on which two layers of tape including glass cloth adhesively coated on one side with mica is applied. EP '694 discloses that each layer is applied with the mica side facing the conductor.

French Publication FR 2 573 910 (FR '910) discloses an insulating layer for electric cables with dielectric and insulating characteristics over a large temperature range. This layer comprises one or more mica layers obtained by helicoidally wrapping one or more tapes made of a glass fabric impregnated by an adhesive supporting mica particles. The mica surface with mica particles is preferably provided facing the structure to be protected. The manufacturing process provides for helicoidally wrapping a first mica tape around the element to be protected by positioning the surface with mica particles to face the element to be protected; and a second mica tape is superposed on the first one with the face covered with mica particles inwardly turned, but with a rotation direction opposite to that of the first tape. All of the mica tapes used has the respective mica surfaces facing the conductors.

The Applicant faced the problem of providing a fire-resistant cable suitable for complying with national and international standards and experienced that the known cables, such that of FR '910, may not be able to pass some tests for obtaining fire-resistance certification.

Fire resistance might be improved by wrapping additional layers of mica tape around the conductor, but increasing the number of layers of mica tape may increase the weight and size of the cable, and may also increase the cost and time to manufacture the cable.

SUMMARY

While mica tape manufacturers typically recommend that the mica surfaces of the mica tape face the conductor and the prior art cables are in line with such advice, the Applicant has found that it is possible to improve the fire resistance of a cable by surrounding the conductor with at least two layers of mica tapes such that the respective mica surfaces of the mica tape face each other.

Without wishing to be bound to a theory, the Applicant perceived that during manufacture of the cable when applying the layers of mica tape with the respective mica surfaces facing towards the conductor, mica particles may break loose during manufacturing and/or cable deployment, thus weakening the fire barrier performance of the mica tape.

By providing the cable with at least one couple of mica tapes such that the respective mica surfaces face each other in a so-called "mica sandwich" configuration, the Applicant found that the cable may exhibit increased fire resistance and better structural integrity under high temperatures, and the mica tapes may provide more effective protection for the conductor to maintain its electrical performance. The cable has been found suitable for obtaining certification under the UL-2196 interim program.

In one aspect, the present disclosure is directed to an electrical cable comprising a conductor and a couple of mica tapes surrounding the conductor. The couple of mica tapes is formed of a first mica tape and a second mica tape wound around the first mica tape, both the tapes including a mica layer attached to a backing layer. The mica layer of the first mica tape faces and contacts the mica layer of the second mica tape. The electrical cable further includes at least one insulation layer surrounding the second mica tape.

In another aspect, the present disclosure is directed to a method of manufacturing an electrical cable. The method includes winding a couple of mica tapes around a conductor. The couple of mica tapes is formed of a first mica tape and of a second mica tape, both including a mica layer attached to a backing layer. The method also Includes winding the second mica tape around the first mica tape so that the mica layer of the first mica tape faces and contacts the mica layer of the second mica tape. The method also includes disposing at least one insulation layer around the couple of mica tapes.

In another aspect, the present disclosure is directed to an electrical cable including a conductor and an inner couple of mica tapes surrounding the conductor and an outer couple of mica tapes surrounding the inner couple. The inner couple of mica tapes is formed of a first mica tape and a second mica tape wound around the first mica tape, both the first and second mica tape including a mica layer attached to a backing layer. The mica layer of the first mica tape faces and contacts the mica layer of the second mica tape. The outer couple of mica tapes is formed of a third mica tape and a fourth mica tape, applied over the third mica tape, both the third and the fourth mica tape including a mica layer attached to a backing layer. The mica layer of the third mica tape faces and contacts the mica layer of the fourth mica tape.

Advantageously, the backing layer of the second mica tape faces and contacts the backing layer of the third mica tape.

The electrical cable further includes at least one insulation layer surrounding the inner and outer couples of mica tapes. Advantageously, the electrical cable includes a first insulation layer surrounding the fourth mica tape and being formed of a silicone-based compound. The electrical cable also includes a second insulation layer surrounding the first insulation layer, and made of a flame-retardant polymer.

In the present description and claims, an "insulation layer" is used herein to refer to a covering layer made of a material having electrically insulating properties, for example, having a dielectric rigidity of at least 5 kV/mm, preferably greater than 10 kV/mm.

For the purpose of the present description and of the appended claims, except where otherwise indicated, all numbers expressing amounts, quantities, percentages, and so forth, are to be understood as being modified in all instances by the term "about." Also, all ranges include any combination of the maximum and minimum points disclosed and include any intermediate ranges therein, which may or may not be specifically enumerated herein.

DESCRIPTION OF THE EMBODIMENTS

Figure 1:
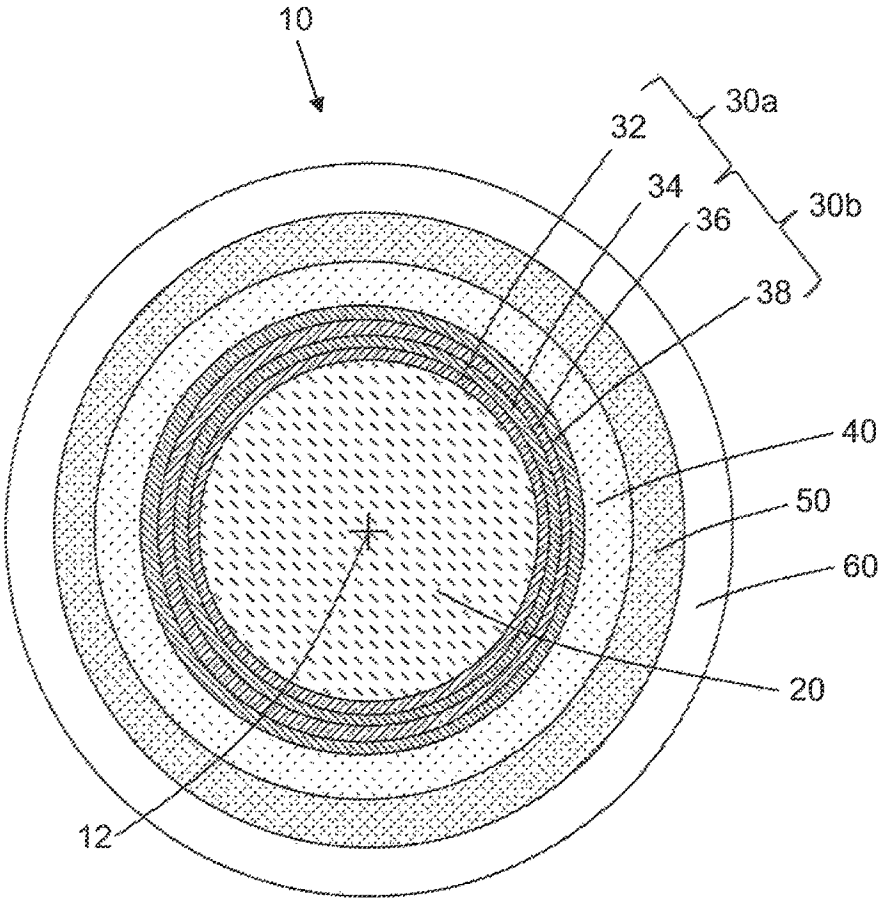
FIG. 1 is a cross-sectional view of an electrical cable, consistent with certain disclosed embodiments.

Reference will now be made in detail to the present exemplary embodiments, an example of which is illustrated in the accompanying drawing. The present disclosure, however, may be embodied in many different forms and should not be construed as limited to the embodiments set forth herein.

Referring now to FIG. 1, an electrical cable 10 has a longitudinal axis 12. The electrical cable 10 may include, in order from the interior to the exterior, an electrical conductor or conductor 20, an inner couple of mica tapes 30*a*, an outer couple of mica tapes 30*b*, and one or more layers sequentially provided in radial external position with respect to the inner and outer couples of mica tapes 30*a*, 30*b*. Such external layer(s) may include a first insulation layer 40, a second insulation layer 50, and, optionally, an outer sheath 60. In some applications, the outer sheath 60 can be omitted.

The conductor 20 may be made of an electrically conducting metal, preferably copper or copper alloy. Although shown in FIG. 1 as a single element, the conductor 20 may be either solid or made of stranded wires. For example, the conductor 20 may be 8 AWG (American wire gauge) (8.36 $mm^2$) 7-strand compressed soft bare copper in accordance with the standards identified by ASTM International as ASTM B8 Class B concentric-lay-stranded copper conductors. Alternatively, the conductor 20 may range in size from about 2 $mm^2$ (14 AWG) to about 500 $mm^2$ (1000 kcmil), but it is understood that the size of the conductor 20 may be greater than or less than this range. For example, for certain circuits and fire alarms, the size of the conductor 20 may be 16 AWG (1.31 $mm^2$) and the conductor 20 may be tested at relatively lower voltages.

The inner and outer couples of mica tapes 30*a*, 30*b* are wound around the conductor 20. The inner couple 30*a* includes a first mica tape 32 and a second mica tape 34. The first mica tape 32 is disposed around the conductor 20 such that the first mica tape 32 contacts and is applied directly onto the conductor 20. The second mica tape 34 is disposed around the first mica tape 32 such that the second mica tape 34 contacts and is applied directly onto the first mica tape 32.

Each of the first mica tape 32 and the second mica tape 34 are formed of a mica layer attached to a backing layer. The mica layer may be formed of one or more types of mica (e.g., muscovite and/or phlogopite). The mica layer may include a mica paper or sheet, which may be impregnated or coated with a binding agent (e.g., silicone resin or elastomer, acrylic resin, and/or epoxy resin). The backing layer may be formed of a supporting fabric (e.g., woven glass and/or glass cloth). The mica layer may be bonded to the backing layer using the binding agent. Alternatively, the mica layer may be impregnated or coated with the binding agent, and reinforced with the backing layer.

The first mica tape 32 is wound onto the conductor 20 such that the backing layer of the first mica tape 32 faces and contacts the conductor 20, and the mica layer of the first mica tape 32 faces away from the conductor 20. Thus, the backing layer of the first mica tape 32 faces radially Inward toward the axis 12 of the cable 10, and the mica layer of the first mica tape 32 faces radially outward away from the axis 12 of the cable 10.

The second mica tape 34 is wound onto the first mica tape 32 such that the mica layer of the second mica tape 34 faces and contacts the mica layer of the first mica tape 32, and the backing layer of the second mica tape 34 faces away from the conductor 20 and the first mica tape 32. Thus, the mica layer of the second mica tape 34 faces radially inward toward the axis 12 of the cable 10, and the backing layer of the second mica tape 34 faces radially outward away from the axis 12 of the cable 10.

In embodiments in which the conductor 20 is made of stranded wires, the first mica tape 32 is preferably wound in an opposite winding direction than the stranding direction of the conductor 20 wires. Advantageously, the second mica tape 34 is wound in a winding direction opposite to the winding direction of the first mica tape 32. The opposite winding direction of the first and second mica tapes 32 and 34 assists in keeping the torque on the conductor 20 minimized so that twisting of the conductor 20 during exposure to fire can be minimized.

For example, the first mica tape 32 may have a right hand winding direction or lay (RHL), and the conductor 20 (or at least an outer layer of wires contained therein) and the second mica tape 34 may have a left hand winding direction or lay (LHL), or vice versa.

Alternatively, both the first mica tape 32 and the second mica tape 34 may have, for example, a RHL, and the conductor 20 may have a LHL. With this winding configuration, the first and second mica tapes 32 and 34 exert a joined torque resistance on the conductor 20.

The first mica tape 32 and the second mica tape 34 may be wound at an angle of from 30° to 60°, preferably of about 45°. Further, the first mica tape 32 and the second mica tape 34 may both have an overlap percentage (e.g., the percentage of the width of the mica tape overlapping onto itself during winding) such that no gaps in the winding of the mica tapes are formed both during manufacturing and deployment of the cable 10. The overlap percentage can be, for example, of 25%.

The cable 10 of FIG. 1 also includes an outer couple of mica tapes 30*b* formed of a third mica tape 36 and a fourth mica tape 38. The third mica tape 36 surrounds or is wound around the second mica tape 34 and may contact the second mica tape 34 directly. The direct contact between the backing layer of the second mica tape 34 and the backing layer of the third mica tape 36 is advantageous for the fire-resistance performance of the couples 30*a* and 30*b* of mica tapes. The fourth mica tape 38 is wound around the third mica tape 36 such that the fourth mica tape 38 contacts and is applied directly onto the third mica tape 36.

The third mica tape 36 and/or the fourth mica tape 38 may be formed of materials similar to those used to form the first mica tape 32 and/or the second mica tape 34. It is understood that the first, second, third, and fourth mica tape 32, 34, 36, and 38, or sub-combinations thereof, may be formed using different or the same mica layer and backing layer.

The third mica tape 36 and the fourth mica tape 38 may be applied in a similar manner as the first mica tape 36 and the second mica tape 34, as described below.

The third mica tape 36 is wound onto the second mica tape 34 such that the backing layer of third mica tape 36 faces and may contact the backing layer of the second mica tape 34, and the mica layer of the third mica tape 36 faces away from the conductor 20 and the first and second mica tapes 32 and 34. Thus, the backing layer of the third mica tape 36 faces radially inward toward the axis 12 of the cable 10, and the mica layer of the third mica tape 36 faces radially outward away from the axis 12 of the cable 10.

The fourth mica tape 38 is wound onto the third mica tape 36 such that the mica layer of the fourth mica tape 38 faces and contacts the mica layer of the third mica tape 36, and the backing layer of the fourth mica tape 38 faces away from the conductor 20 and the first, second, and third mica tape 32, 34, and 36. Thus, the mica layer of the fourth mica tape 38 faces radially inward toward the axis 12 of the cable 10, and the backing layer of the fourth mica tape 38 faces radially outward away from the axis 12 of the cable 10.

The third mica tape 36 may be wound in an opposite winding direction than the fourth mica tape 38. Also, the third mica tape 36 may be applied in the same winding direction as the first mica tape 32, and the fourth mica tape 38 may be applied in the same winding direction as the second mica tape 34. For example, the third mica tape 36 may have a RHL and the fourth mica tape 38 may have a LHL, or vice versa. The third mica tape 36 and the fourth mica tape 38 may be wound at an angle of, for example, 45°. Further, the third mica tape 36 and the fourth mica tape 38 may both have an overlap percentage of, for example, 25%.

The mica layer of one or more of the mica tape 32, 34, 36, 38 may have dimensions (thickness and width) such that the tapes can be applied around the conductor 20 minimizing wrinkles and folds as much as possible. Wrinkles and folds may potentially cause the mica tapes to be vulnerable to damage. For example, the mica layer of one or more of the mica tape 32, 34, 36, 38 has a nominal thickness of 0.005 inches (0.127 mm) and a nominal width of approximately 0.5 inches (12.7 mm). The term "thickness" used herein refers to the dimension of the mica tape extending radially with respect to the axis 12 of the cable 10 when the mica tape is applied to the cable 10. The term "width" used herein refers to the dimension of the mica tape orthogonal to the thickness and to the application direction of the mica tape.

The layers sequentially provided in radial external position with respect to the inner and outer couples of mica tapes 30*a*, 30*b*, e.g., the first insulation layer 40, the second insulation layer 50, and/or the outer sheath 60, may be extruded onto the inner and outer couples of mica tapes 30*a*, 30*b*. The first insulation layer 40, the second insulation layer 50, and/or the outer sheath 60 may be formed of compounds that emit less smoke and little or no halogen when exposed to high sources of heat, e.g., low smoke zero halogen (LSOH) compounds, and that have low toxicity flame retardant properties.

In the embodiment shown in FIG. 1, the first insulation layer 40 surrounds the fourth mica tape 38 such that the first Insulation layer 40 contacts and is applied directly onto the fourth mica tape 38. Alternatively, if the third and fourth mica tape 36 and 38 are omitted, then the first insulation layer 40 surrounds the second mica tape 34 such that the first insulation layer 40 contacts and is applied directly onto the second mica tape 34. The first insulation layer 40 may have a nominal thickness selected according to the requirement of national or international standards, generally on the basis of the conductor size. The thickness of the first insulation layer 40 may be, for example, at least 0.045 inches (1.143 mm).

The first insulation layer 40 may be formed of a silicone-based compound, such as a silicone-based rubber. The silicone-based rubber may form a matrix incorporating at least one mineral flame-retardant filler, e.g., to protect the material of the first insulation layer 40 during manufacturing and installation of the cables within the conduit. The mineral fillers may be incorporated into the silicone-based compound using a bonding agent, such as silane, and the silicone-based compound may be cured using a cure catalyst, such as peroxide.

At higher temperatures experienced during fire conditions, e.g., at temperatures of greater than or equal to approximately 600° C., the silicone-based compound may form silicon dioxide ash. At these higher temperatures, the silicon dioxide ash formed by the first insulation layer 40 and the mica tapes of the couples of mica tapes 30*a*, 30*b* may link and form a continuous eutectic mixture that may serve as a dielectric for the cable 10 to allow the cable 10 to continue operating.

The silicone-based compound may also be a ceramifiable polymer that ceramifies at higher temperatures experienced during fire conditions, e.g., at temperatures of approximately 600° C. to 900° C. At these higher temperatures, the ceramifiable polymer may change from a flexible rubber-like material to a more solid, ceramic-like material.

The second insulation layer 50 surrounds the first insulation layer 40 such that the second insulation layer 50 contacts and is applied directly onto the first insulation layer 40. The second insulation layer 50 may have a nominal thickness as prescribed by the relevant national or international standards.

The second insulation layer 50 may be formed of a thermoplastic polymer or of a thermosetting polymer. For example, the second insulation layer 50 may be formed of a polyolefin, an ethylene copolymer (e.g., ethylene-vinyl acetate (EVA) or linear low density ethylene (LLDPE)), and/or a mixture thereof. Examples of polymers or polymeric mixtures suitable for the second insulation layer 50 are described in U.S. Pat. Nos. 6,495,760, 6,552,112, 6,924,031, 8,097,809, EP0893801, and EP0893802.

The polymer of the second insulation layer 50 is added with a non-halogen, inorganic flame retardant filler, such as magnesium hydroxide and/or aluminum hydroxide in an amount suitable to confer flame-retardant properties to the second insulation layer 50 (for example from 30 wt % to 70 wt % of inorganic flame retardant filler with respect to the total weight of the polymeric mixture).

The outer sheath 60 surrounds the second insulation layer 50 such that the outer sheath 60 contacts and is applied directly onto the second insulation layer 50. The outer sheath 60 may be formed of a polymeric material, such as high-density polyethylene (HDPE).

The cable 10 constructed as described above may be a thermoset wire that be used in various conditions, such as the conditions specified for a Type RHW-2 cable in the National Electrical Code® (NEC®). The cable 10 may have a voltage rating of from 72 to 600 volts and may be fire rated at from 72 to 600 volts.

One or more of the cables 10 may be deployed in a conduit (not shown). In some embodiments, the conduit may include four of the cables 10, but it is understood that more or fewer than four of the cables 10 may be included in the conduit.

The conduit fill, e.g., the percentage of a section of the conduit that is filled by the cable 10, may range from approximately 14% to 40%, but it is understood that the conduit fill may also be less than this range. For a conduit including four of the cables 10 with 17% fill, the nominal diameter of the conduit may be approximately 1.5 inches (38.10 mm), the outer diameter of the conduit may be approximately 1.74 inches (44.20 mm), and the inner diameter of the conduit may be approximately 1.61 inches (40.89 mm). For a conduit including four of the cables 10 with 40% fill, the nominal diameter of the conduit may be approximately 1.0 inches (25.4 mm), the outer diameter of the conduit may be approximately 1.163 inches (29.54 mm), and the inner diameter of the conduit may be approximately 1.049 inches (26.64 mm). It is understood that the diameters may be greater than or less than these values.

The cable of the invention is suitable for passing stringent fire resistive testing that challenges the capacity of the cable to carry current in the presence of fire and of water.

While mica tape manufacturers may typically recommend that the mica surface of the mica tape face and/or be in contact with the conductor, the Applicant has found to the contrary that it is more effective for improving fire resistance to sandwich together the mica layers of two adjacent mica tapes. Sandwiching the mica layers could assure the integrity of the mica layers, which allows the cable of the invention to resist higher temperatures, thereby improving the fire resistance of the cable, and therefore protects the electrical performance of the electrical conductor.

The cable of the invention may advantageously include four mica tapes. When four of the mica tapes are applied, the third mica tape and the fourth mica tape are preferably applied in a similar manner as the first mica tape and the second mica tape. That is, the third mica tape may be applied with the mica layer facing up (away from the second mica tape), and the fourth mica tape may be applied with the mica layer facing down towards the third mica tape. As a result, the mica layers of the third mica tape and the fourth mica tape may be sandwiched together.

The cable of the invention may include one couple of mica tapes, and such a construction may be sufficient for various sizes of the cable to pass horizontal fire wall tests. The Applicant has found that including two couples of mica tapes may improve the fire resistance of the cable of the invention, e.g., to be able to pass both horizontal and vertical fire wall tests.

Example: A number of cables according to the invention and comparative cables have the construction features according to Table 1.

TABLE 1

| Cable | 1 | 2 | 3 | 4* | 5* | 6* |
|---|---|---|---|---|---|---|
| Conductor Size | 750 MCM (380 $mm^2$) | 8AWG (8.36 $mm^2$) | 8AWG (8.36 $mm^2$) | 8AWG (8.36 $mm^2$) | 8AWG (8.36 $mm^2$) | 10AWG (5.26 $mm^2$) |

TABLE 1-continued

| Cable | 1 | 2 | 3 | 4* | 5* | 6* |
|---|---|---|---|---|---|---|
| Number of Mica Tapes | 4 (2 couples) | 4 (2 couples) | 2 (1 couple) | 2 (1 couple) | 1 | 1 |
| Mica Tape Overlap | 25% | 25% | 25% | 25% | 50% | 50% |
| Mica Facing | up/down (x2) | up/down (x2) | up/down | down/down | down | down |
| Mica Tape Winding Direction | up = RHL down = LHL | up = RHL down = LHL | up = RHL down = RHL | down = RHL down = RHL | RHL | RHL |

Cables marked with an asterisk (*) are comparative cables.

"Mica facing" refers to the directions that the mica layers of the mica tapes are facing. For example, "up/down" means that there is one couple of mica tapes including one mica tape with the mica layer facing up and one mica tape with the mica layer facing down such that the mica layers are sandwiched together. "Up/down (×2)" means that there are two couples of mica tapes with each couple having the "up/down" orientation. "Down/down" means that there is one couple of mica tapes and the mica layer of each mica tape faces down. "Down" means that there is one mica tape and the mica layer of the mica tape faces down.

"Mica tape winding direction" refers to the winding direction of the mica tapes. "Up=RHL" means that the mica tape with the upward-facing mica layer has RHL, "down=LHL" means that the mica tape with the downward-facing mica layer has LHL, and "down=RHL" means that the mica tape with the downward-facing mica layer has RHL.

All of the cables of Table 1 were Type RHW-2 cable having a voltage rating of 600 volts and a fire rating of 480 volts includes 8 AWG (8.36 $mm^2$) 7-strand compressed soft bare copper in accordance with ASTM B8 Class B concentric-lay-stranded copper conductors. Four layers of mica tape (Cablosam® 366.21-30 from Von Roll Switzerland Ltd) having a nominal thickness of approximately 0.005 inches (0.127 mm) and a nominal width of approximately 0.5 inches (12.7 mm) are applied on top of the conductor.

All of the cables of Table 1 had an insulating layer of LSOH low toxicity flame retardant silicon insulation applied over the mica tape(s), and a polymeric flame retardant layer of LSOH low toxicity flame retardant polyolefin (UNIGARD™ RE HFDA-6525 from The Dow Chemical Company) applied over the insulating layer.

The cables of Table 1 were tested according to UL-2196 with the configuration test given in Table 2. Table 2 also reports the outcome of such tests.

TABLE 2

| Cable | 1 | | | 2 | | | 3 | | | 4* | | 5* | 6* |
|---|---|---|---|---|---|---|---|---|---|---|---|---|---|
| Conduit Position | V | H | H | V | V | V | V | V | V | V | V | V | V |
| Conduit Fill (%) | 19 | 32 | 40 | 17 | 40 | 14 | 16 | 21 | 36 | 32 | 26 | | |
| Failing Samples | 0 of 5 | 0 of 1 | 0 of 1 | 0 of 5 | 0 of 1 | 0 of 1 | 0 of 5 | 1 of 2 | 2 of 2 | 1 of 1 | 2 of 2 | | |

"Conduit position" refers to the mounting orientation of the conduit on the fire wall, i.e., vertical ("V") or horizontal ("H").

As shown in Table 2, all of the cables according to the invention passed the fire-test at different test conditions, while the comparative cables had at least one sample failing, which is not acceptable by the standards used for the present testing.

It will be apparent to those skilled in the art that various modifications and variations can be made to the structure of the cable disclosed herein without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An electrical cable comprising a conductor and a couple of mica tapes surrounding the conductor, the couple of mica tapes being formed of a first mica tape and a second mica tape wound around the first mica tape, each of the first and the second mica tape including a mica layer attached to a backing layer, wherein the mica layer of the first mica tape faces and contacts the mica layer of the second mica tape.

2. The electrical cable of claim 1, further comprising at least one insulation layer surrounding the couple of mica tapes.

3. The electrical cable of claim 1, wherein the couple of mica tapes is an inner couple of mica tapes surrounding the conductor, the electrical cable further comprising an outer couple of mica tapes surrounding the inner couple, the outer couple of mica tapes being formed of a third mica tape and a fourth mica tape wound around the third mica tape, the third and the fourth mica tape including a mica layer attached to a backing layer, wherein the mica layer of the third mica tape faces and contacts the mica layer of the fourth mica tape.

4. The electrical cable of claim 3, wherein the backing layer of the second mica tape faces and contacts the backing layer of the third mica tape.

5. The electrical cable of claim 3, further comprising at least one insulation layer surrounding the inner and the outer couple of mica tapes.

6. The electrical cable of claim 3, further comprising a first insulation layer and a second insulation layer.

7. The electrical cable of claim 6, wherein the first insulation layer is formed of a silicone-based compound.

8. The electrical cable of claim 7, wherein the silicone-based compound includes a silicone-based rubber forming a matrix with a flame-retardant mineral filler incorporated into the matrix.

9. The electrical cable of claim 6, wherein the second insulation layer is made of a flame-retardant polymer.

10. The electrical cable of claim 1, wherein the first mica tape is wound in a winding direction that is opposite to a winding direction of the second mica tape.

11. The electrical cable of claim 1, further comprising a first insulation layer and a second insulation layer.

12. The electrical cable of claim 11, wherein the first insulation layer is formed of a silicone-based compound.

13. The electrical cable of claim 12, wherein the silicone-based compound includes a silicone-based rubber forming a matrix with a flame-retardant mineral filler incorporated into the matrix.

14. The electrical cable of claim 11, wherein the second insulation layer is made of a flame-retardant polymer.

15. A method of manufacturing an electrical cable comprising a conductor and a couple of mica tapes surrounding the conductor, the couple of mica tapes being formed of a first mica tape and a second mica tape wound around the first mica tape, each of the first and the second mica tape including a mica layer attached to a backing layer, the method comprising:

winding the first mica tape around the conductor so that the backing layer of the first mica tape faces the conductor; and winding the second mica tape around the first mica tape so that the mica layer of the second mica tape faces and contacts the mica layer of the first mica tape.

16. The method of claim 15, further comprising:

winding a third mica tape around the second mica tape, the third mica tape being formed of a third mica tape including a mica layer attached to a backing layer, the backing layer of the second mica tape facing and contacting the backing layer of the third mica tape; and winding a fourth mica tape around the third mica tape, the fourth mica tape being formed of a fourth mica tape including a mica layer attached to a backing layer, the mica layer of the third mica tape facing and contacting the mica layer of the fourth mica tape.

* * * * *